US006682419B2

(12) United States Patent
Webb et al.

(10) Patent No.: US 6,682,419 B2
(45) **Date of Patent: *Jan. 27, 2004**

(54) GAMING DEVICE HAVING A PRIMARY GAME SCHEME INVOLVING A SYMBOL GENERATOR AND SECONDARY AWARD TRIGGERING GAMES

(75) Inventors: Bayard S. Webb, Sparks, NV (US); Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/174,789

(22) Filed: Jun. 19, 2002

(65) Prior Publication Data

US 2002/0160828 A1 Oct. 31, 2002

Related U.S. Application Data

(63) Continuation of application No. 09/689,495, filed on Oct. 12, 2000, now Pat. No. 6,461,241.

(51) Int. Cl.[7] ..... A63F 5/00

(52) U.S. Cl. ..... 463/16; 463/9; 463/17; 463/18; 463/19; 463/20; 463/21; 463/22; 273/148 B; 273/153 R; 273/459; 273/460; 273/461

(58) Field of Search ..... 463/16, 17, 9, 463/18–22, 1; 273/138.1, 139, 148 B, 85, 459, 143 R, 269, 460

(56) References Cited

U.S. PATENT DOCUMENTS

| | | | |
|---|---|---|---|
| 4,695,053 | A | 9/1987 | Vazquez, Jr. et al. |
| 4,775,155 | A | 10/1988 | Lees |
| 5,393,057 | A | 2/1995 | Marnell, II |
| 5,411,271 | A | 5/1995 | Mirando |
| 5,536,016 | A | 7/1996 | Thompson |
| 5,611,730 | A | 3/1997 | Weiss |
| 5,639,089 | A | 6/1997 | Matsumoto et al. |
| 5,641,730 | A | 6/1997 | Brown |
| 5,645,486 | A | 7/1997 | Nagao et al. |
| 5,755,619 | A | 5/1998 | Matsumoto et al. |
| 5,788,573 | A | 8/1998 | Baerlocher et al. |
| 5,823,874 | A | 10/1998 | Adams |
| 5,833,537 | A | 11/1998 | Barrie |
| 5,848,932 | A | 12/1998 | Adams |

(List continued on next page.)

FOREIGN PATENT DOCUMENTS

| | | |
|---|---|---|
| EP | 0 449 433 A2 | 2/1991 |
| GB | 2 137 392 A | 10/1984 |
| WO | WO 00/12186 | 3/2000 |

OTHER PUBLICATIONS

Bingo Game Brochure written by Casino Data System, published in 1998.
Jackpot Bingo written by CDS.com, printed Apr. 12, 2001.
Full House Brochure written by Anchor Games, published in 2000.
Match Reel Game Bonus Description written by IGT, published date unknown.
Jewel in the Crown Brochure written by Barcrest, Ltd, published date unknown.

*Primary Examiner*—A. L. Wellington
*Assistant Examiner*—Y. Cherubin
(74) *Attorney, Agent, or Firm*—Bell, Boyd & Lloyd LLC

(57) ABSTRACT

The present invention involves a gaming device with a primary game scheme which includes one or more symbol generators and one or more secondary games. When the symbol generator generates one or more predetermined symbols, the gaming device operates one or more secondary games. If the player reaches a win condition in one or more secondary games, the gaming device provides the player with an award. This type of game scheme adds excitement to bonus rounds and increases player entertainment.

61 Claims, 8 Drawing Sheets

U.S. PATENT DOCUMENTS 5,851,148 A 12/1998 Brune et al.
5,882,261 A 3/1999 Adams
5,927,714 A 7/1999 Kaplan
5,935,002 A 8/1999 Falciglia
5,947,820 A 9/1999 Morro et al.
5,980,384 A 11/1999 Barrie
5,997,401 A 12/1999 Crawford
6,019,369 A 2/2000 Nakagawa et al.
6,059,658 A 5/2000 Mangano et al.
6,089,976 A 7/2000 Schneider et al.
6,089,978 A 7/2000 Adams
6,093,102 A 7/2000 Bennett
6,120,377 A 9/2000 McGinnis, Sr. et al.
6,126,542 A 10/2000 Fier
6,186,894 B1 2/2001 Mayeroff

GAMING DEVICE HAVING A PRIMARY GAME SCHEME INVOLVING A SYMBOL GENERATOR AND SECONDARY AWARD TRIGGERING GAMES

PRIORITY CLAIM

This application is a continuation of and claims the benefit of U.S. patent application Ser. No. 09/689,495, filed Oct. 12, 2000, now U.S. Pat. No. 6,461,241.

CROSS-REFERENCE TO RELATED APPLICATIONS

This application is related to the following commonly-owned co-pending patent applications: "GAMING DEVICE HAVING A SELECTIVELY ACCESSIBLE BONUS SCHEME," Ser. No. 09/657,916; "GAMING DEVICE HAVING A PRIMARY GAME SCHEME INVOLVING A SYMBOL GENERATOR AND SECONDARY AWARD TRIGGERING GAMES," Ser. No. 09/689,495, and "GAMING DEVICE HAVING A PRIMARY GAME SCHEME INVOLVING A SYMBOL GENERATOR AND SECONDARY AWARD TRIGGERING GAMES," Ser. No. 10/174,790.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device which has a primary game scheme which involves at least one symbol generator and at least one secondary game which is used to trigger one or more awards.

BACKGROUND OF THE INVENTION

Contemporary gaming devices such as slot machines include a primary game and one or more bonus rounds. The primary games typically enable a player to generate one or more symbols using a symbol generator. The traditional symbol generator is a set of reels, where each reel displays a plurality of symbols. If the player reaches a predetermined combination of symbols, the player wins a value. In addition, if the player reaches a bonus triggering event, the gaming device advances the player to a bonus round where the player can accumulate additional values. The traditional bonus triggering event occurs when the player reaches a predetermined combination of symbols on a plurality of reels.

The existing primary games provide players with values and bonus triggering events based upon symbols that a player reaches using a symbol generator. These gaming devices do not include secondary games which accompany the symbol generator, wherein the secondary games also provide the player with values, bonus triggering events or other awards.

To increase player enjoyment and excitement, it is desirable to provide players with new game schemes for gaming devices which include a symbol generator and one or more secondary games for providing players with awards such as values and bonus triggering events.

SUMMARY OF THE INVENTION

The present invention overcomes the above shortcomings by providing a gaming device having a primary game which includes one or more, but preferably one, symbol generator and one or more secondary games. A symbol generator can be any mechanism in physical or video form, any mathematical calculation or model, any computer program or any technique which generates one or more symbols. Preferably, the symbol generator is a set of rotating reels where each reel displays a set of symbols. However, a symbol generator can involve other concepts such as a rotating wheel divided into a plurality of areas with symbols on those areas, a set of dice, one or more coins or a physical or virtual container which mixes a plurality of symbols and generates one or more symbols.

A secondary game can be any activity which provides a player with the opportunity to gain an award. The term award, as used herein includes one or more values or an opportunity to gain one or more values. Such an opportunity can be provided by triggering a bonus round. Preferably, a secondary game requires the player to complete a plurality of steps before reaching a win condition. When the player reaches a win condition in the secondary game, the gaming device provides the player with an award. Some examples of the preferred secondary games which require step-by-step progression are: (a) games which require a player to align a predetermined number of markers on a grid in a particular pattern; (b) games which involve the player competing against the gaming device, incorporating concepts such as those used in tic-tac toe, chess or checkers; and (c) games involving races and chases where the race or chase is carried out in a step-by-step process.

In operation, when the symbol generator generates one or more predetermined symbols, the gaming device operates or plays one or more secondary games. The gaming device may do so by enabling the player to use an input device to play the secondary game or the gaming device may automatically play the secondary game. If the player reaches a win condition in the secondary game, the gaming device provides the player with an award.

In one preferred embodiment, the symbol generator is a plurality of reels displaying a plurality of symbols, and each reel is associated with an independent secondary game. The secondary game involves a grid including a plurality of locations. When the player aligns a predetermined number of markers in a predetermined pattern on the grid, a win condition occurs. In operation, if a reel displays a predetermined symbol, the gaming device operates or plays the secondary game associated with that reel. The gaming device does so by displaying a marker at a particular location on the associated secondary game. Where the gaming device locates the marker can be predetermined or determined by the computer of the gaming device during the game. Preferably, the reel indicates where the marker will be located with a symbol which bears a message. Each time the reels spin, the process of generating a predetermined symbol and displaying a marker on the associated secondary game repeats itself until a win condition occurs. However, it should be appreciated that the symbols on a reel will not include a marker upon each spin of the reels.

In this embodiment, it is also preferable that each location on the grid of each secondary game is associated with a value. When a marker is positioned on the location, the player gains the value associated with that location. It is also preferable that the gaming device uses a cross-game symbol in conjunction with displaying a marker on a secondary game. A cross-game symbol is any symbol which is used by or displayed on the symbol generator and which is also used by or displayed on the secondary games. Preferably, the cross-game symbol is the same as the marker. Here, each reel displays at least one cross-game symbol, and when the symbol generator generates one or more predetermined symbols, the gaming device moves the cross-game symbol from the reels to the secondary games associated with such reels.

The game scheme of the present invention adds one or more secondary games to the traditional symbol generator used in primary games. When the symbol generator generates one or more predetermined symbols, the gaming device operates or plays one or more secondary games. When a player reaches a win condition in a secondary game, the gaming device provides the player with one or more of a variety of awards. Preferably, the award is a credit, bonus value or the triggering of a bonus round where the player can accumulate additional bonus value or credits.

It is therefore an object of the present invention to provide a gaming device having a game scheme involving a symbol generator and secondary award triggering games.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
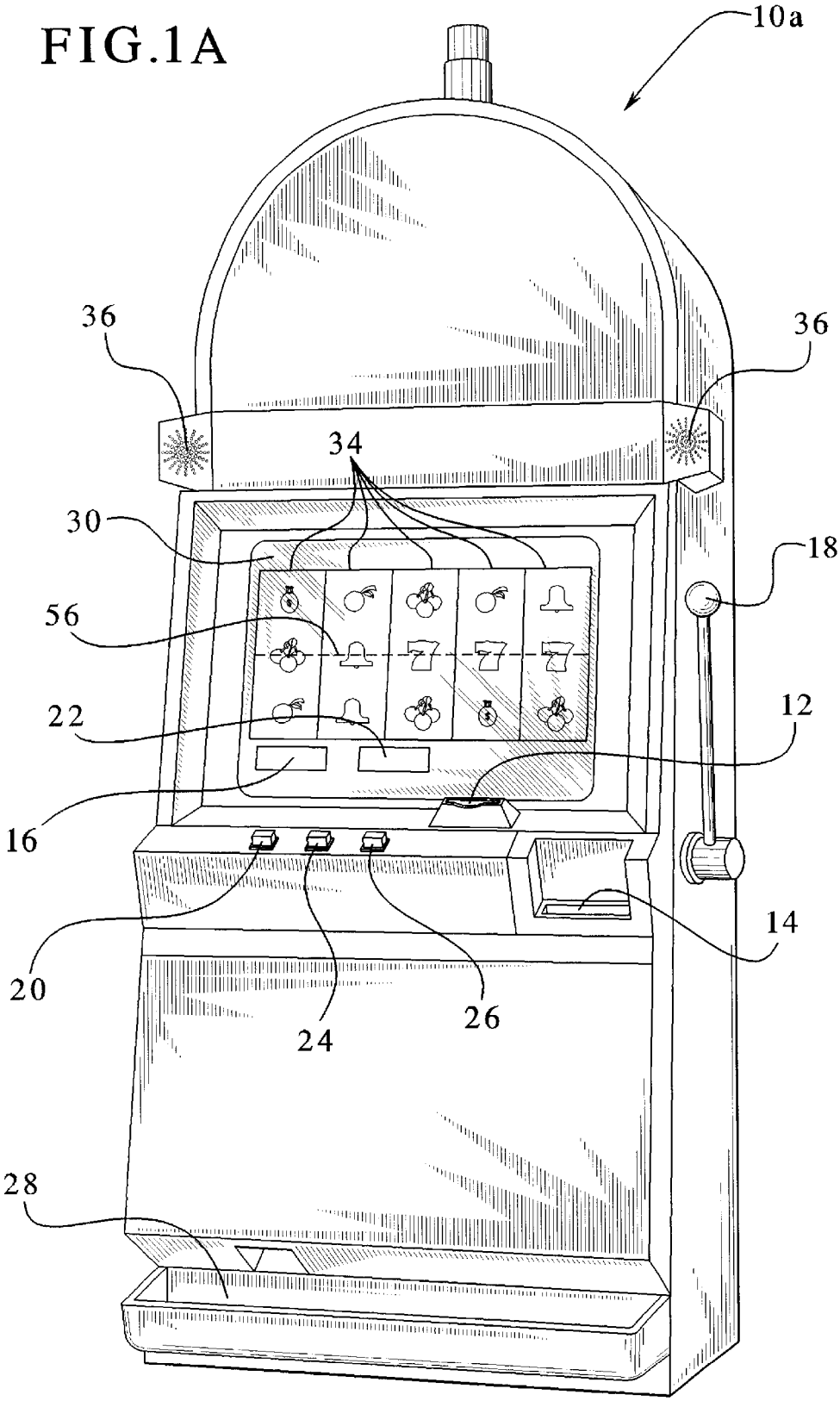
FIG. 1A is a perspective view of one embodiment of the gaming device of the present invention.
Figure 1B:
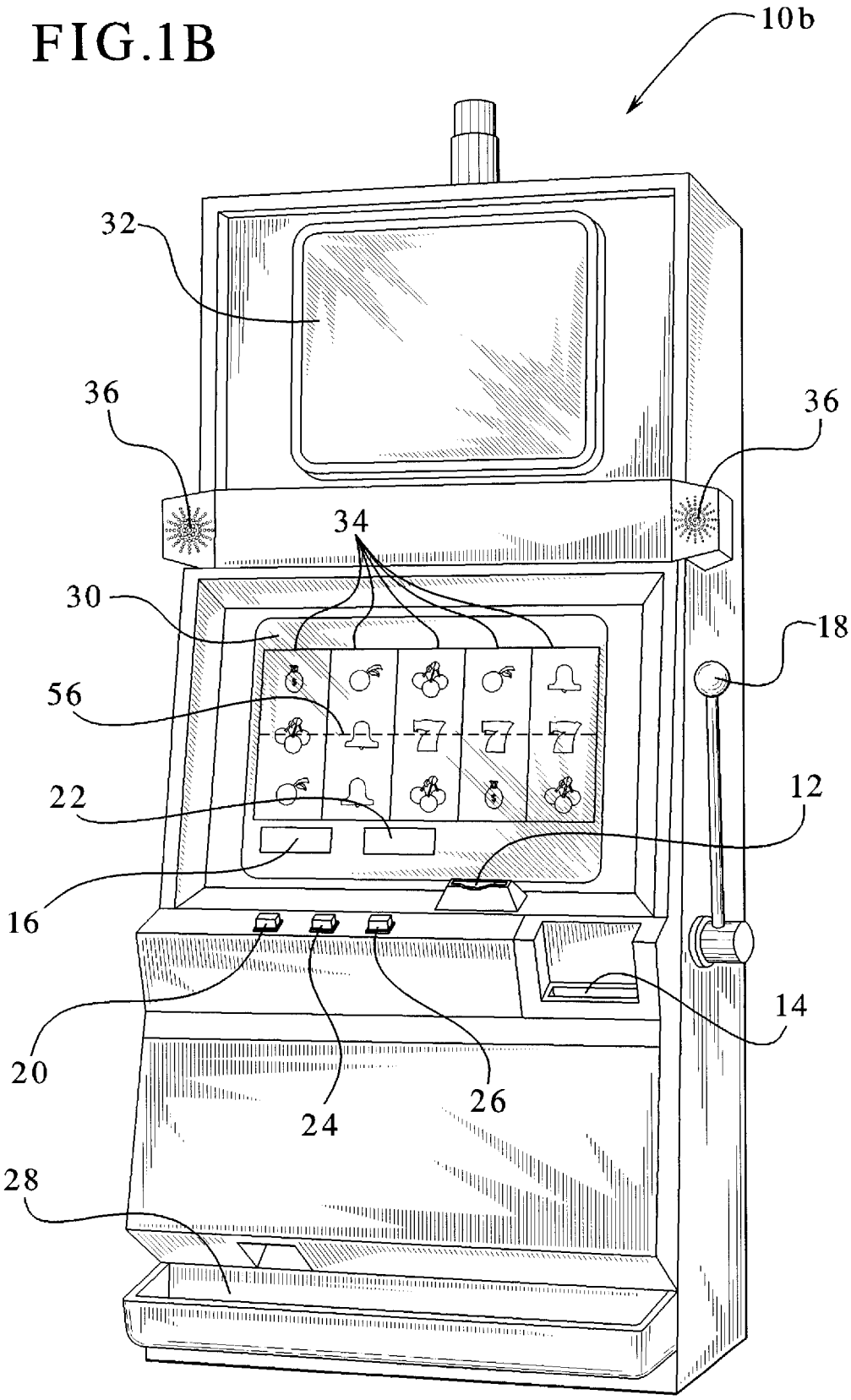
FIG. 1B is a perspective view of another embodiment of the gaming device of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is preferably a slot machine having the controls, displays and features of a conventional slot machine. It is constructed so that a player can operate it while standing or sitting, and gaming device 10 is preferably mounted on a console. However, it should be appreciated that gaming device 10 can be constructed as a pub-style table-top game (not shown) which a player can operate preferably while sifting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker or keno, any of their bonus triggering events and any of their bonus round games. The symbols and indicia used on and in gaming device 10 may be in mechanical, electrical or video form.

As illustrated in FIGS. 1A and 1B, gaming device 10 includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

At any time during the game, a player may "cash out" and thereby receive a number of coins corresponding to the number of remaining credits by pushing a cash out button 26. When the player "cashes out," the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. Gaming device 10 preferably displays a plurality of reels 34, preferably three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
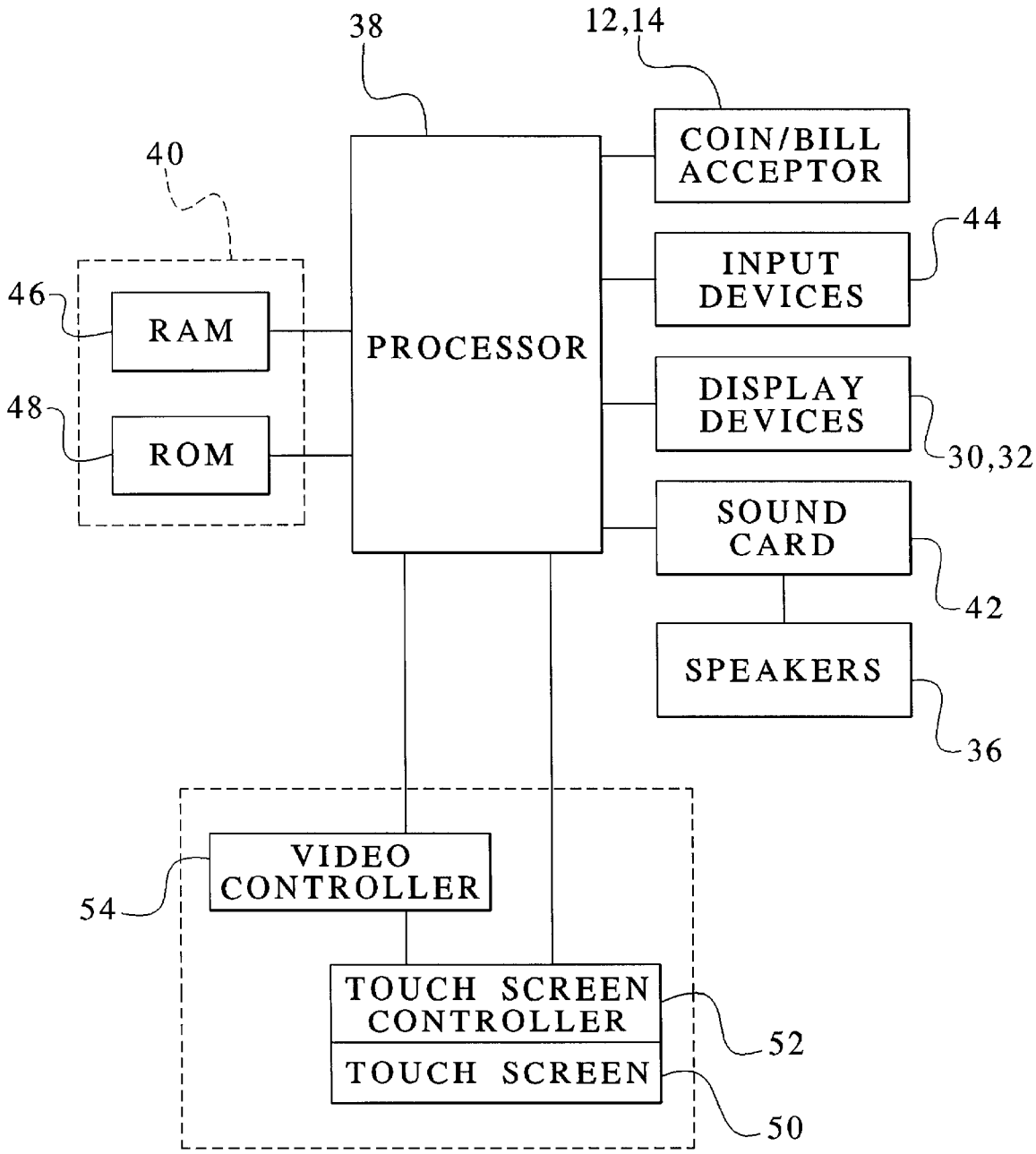
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the "computer" or "controller."

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Game Scheme

The game scheme of the present invention includes one or more symbol generators 100, preferably one, in a primary game and one or more secondary games 102. The preferable symbol generator 100 (shown in FIGS. 6, 7 and 8) is a set of video reels 34. However, it should be appreciated that the present invention can include any type of symbol generator 100. Similarly, the present invention can include any type of secondary game 102. Preferably, the secondary game 102 requires the player to complete a predetermined plurality of steps before achieving a win condition in the secondary game 102.

Figure 3:
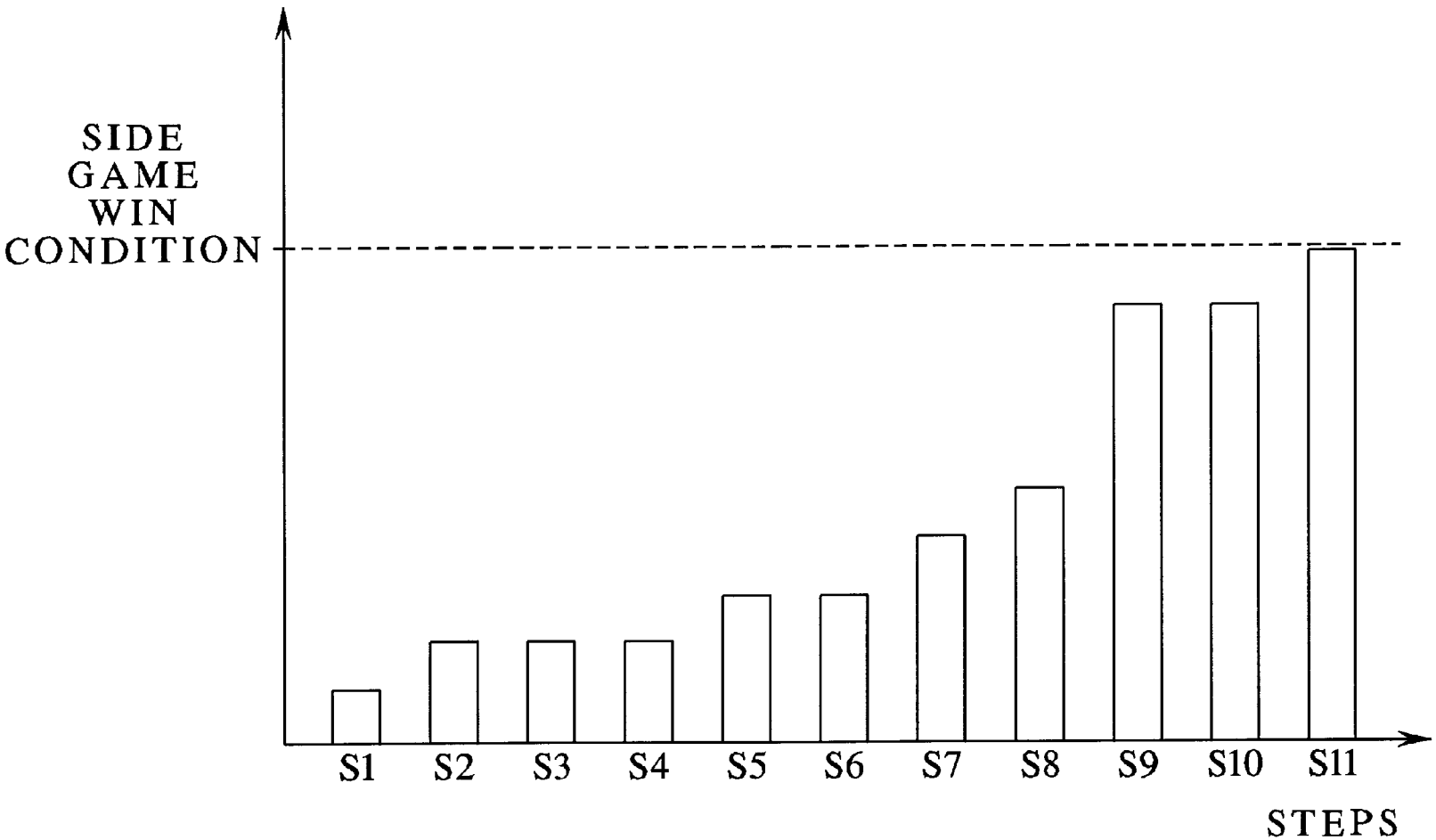
FIG. 3 is a bar graph illustrating a plurality of steps taken to reach a secondary game win condition in one embodiment of the present invention.

As illustrated in FIG. 3, one preferred secondary game 102 could require a player to complete eleven steps before achieving a win condition. The steps are indicated by the notation, S1 through S11. This example is included merely for illustrative purposes and any secondary game 102 can require any number of steps to be taken. This type of step-by-step secondary game 102 preferably incorporates one or more concepts of the following types of games: (a) games requiring a player to align a predetermined number of markers in a predetermined pattern on a grid, such as bingo; (b) tic-tac-toe; (c) chess; (d) checkers; (e) games where the player competes against the gaming device, such as race games or chase games; and (f) any other game where the player is unable to achieve a win condition in one step.

Figure 4A:
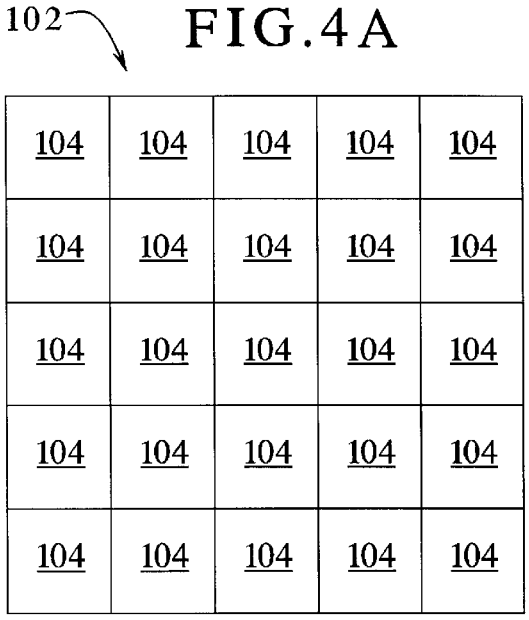
FIGS. 4A and 4B are top plan views of a secondary game in one embodiment of the present invention.
Figure 4B:
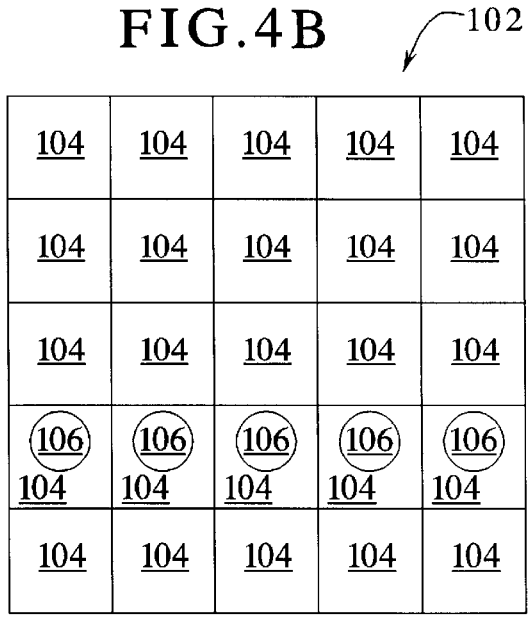

Two such step-by-step secondary games 102 are shown in FIGS. 4A, 4B, 5A, 5B and 5C. In FIGS. 4A and 4B, the secondary game 102 involves a plurality of locations 104 arranged in a grid. The object of the game is to position a complete row or column of markers 106 on the grid. In the example shown in FIG. 4A, the secondary game 102 initiates with no markers 106 being displayed on any of the locations 104. With each step, the gaming device positions a marker 106 on a location 104. Where the gaming device locates a marker 106 can be predetermined by the gaming device or determined by the gaming device during the operation of the secondary game 102. In the latter case, the gaming device can determine locations for the marker 106 randomly or by using any predetermined mathematical calculation. When the gaming device establishes a complete row or column of markers 106, a win condition occurs. In the example shown in FIG. 4B, the gaming device established a complete row of markers 106 in the second to last row of the grid of secondary game 102. This event established a win condition.

Figure 5A:
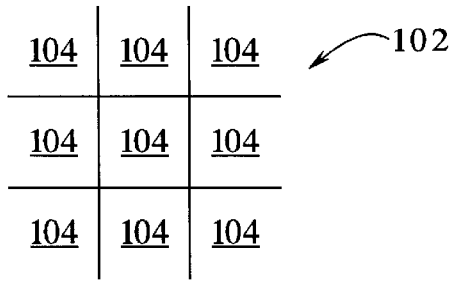
FIGS. 5A, 5B and 5C are top plan views of another secondary game in one embodiment of the present invention.
Figure 5B:
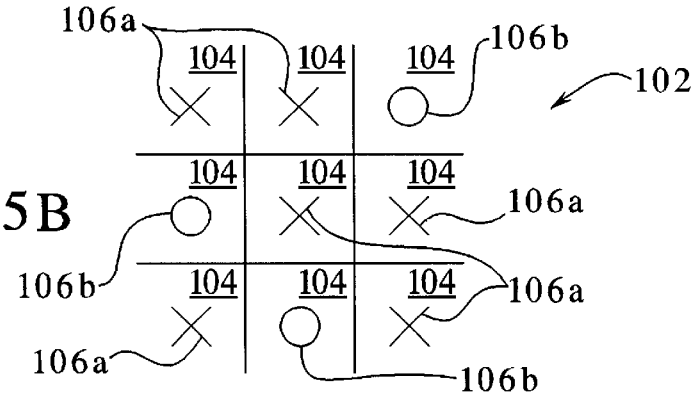
Figure 5C:
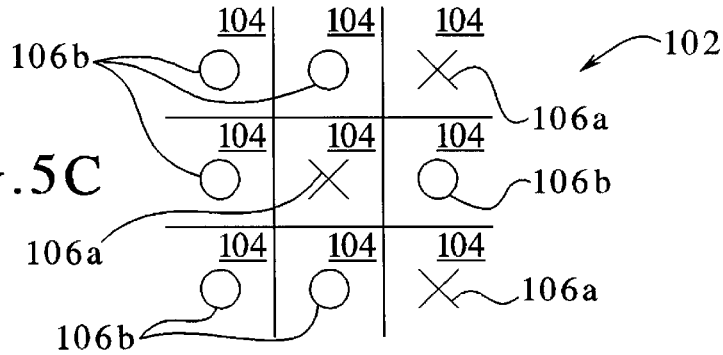

FIGS. 5A through 5C illustrate a secondary game 102 which involves the game tic-tac-toe. In this secondary game 102, the player competes against the gaming device. If the player establishes a line of three markers 106*a* on three locations 104, a win condition occurs. If the gaming device establishes a line of three markers 106*b* on three locations 104, the secondary game 102 preferably clears all markers from the secondary game 102 and restarts the game. This type of secondary game 102 operates in steps by a player using an input device to display a marker 106*a* followed by the computer of the gaming device displaying a marker 106*b*. In FIG. 5A, the secondary game is shown at the beginning of the game with no markers 106. FIG. 5B shows the end of a game, where the player reached a win condition by establishing a diagonal line of markers 106*a*. FIG. 5C shows a point in the game which preceeds the game being restarted. It should be appreciated that the game scheme of the present invention can include secondary games 102 which would not require steps and secondary games 102 which do require steps. For example, a secondary game could be a type of symbol generator in and of itself.

Figure 6:
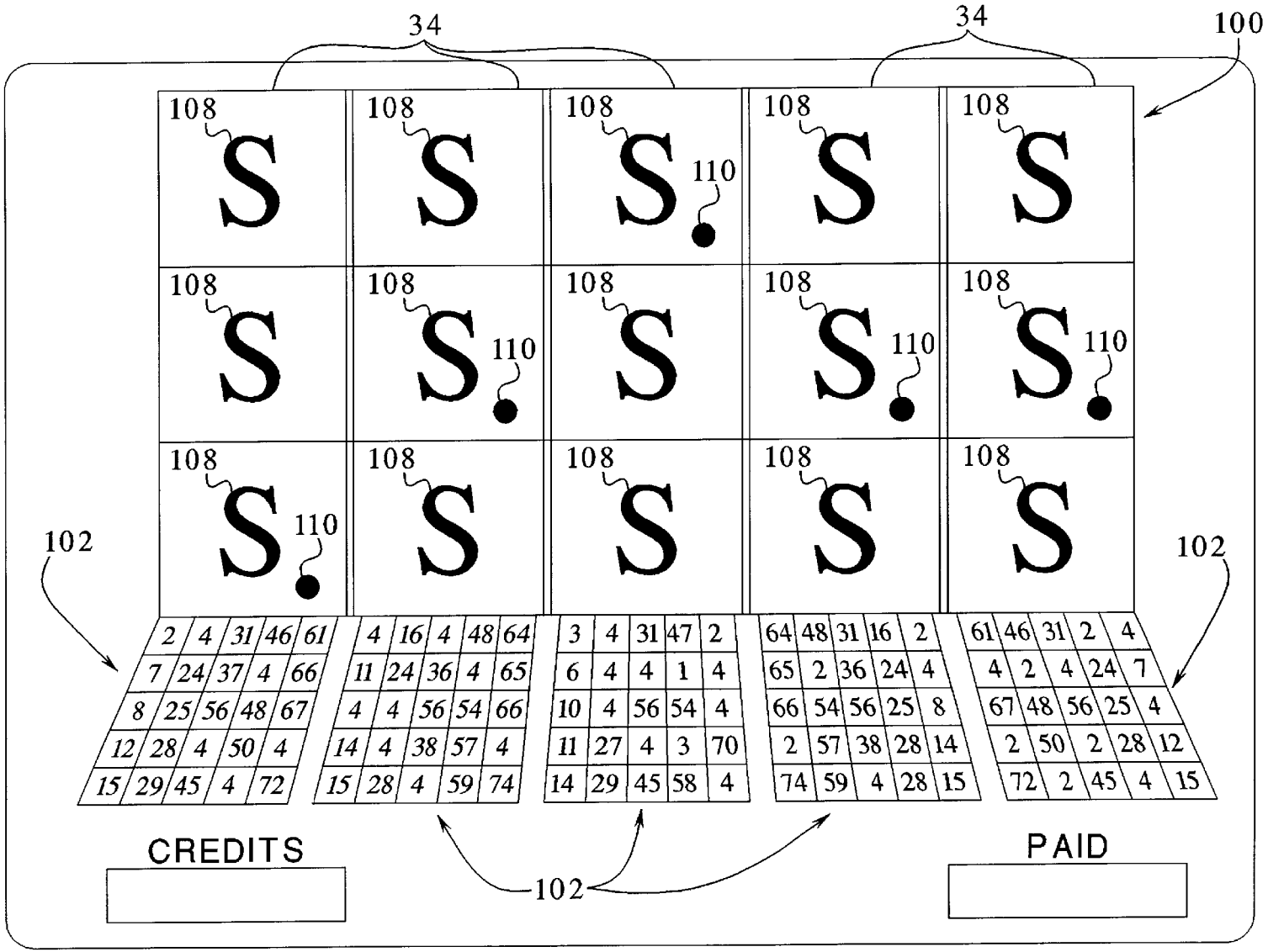
FIG. 6 is a top plan view of the initiation of a primary game in one embodiment of the present invention.

FIG. 6 illustrates a preferred embodiment of the present invention which includes the preferred primary game of the present invention and step-by-step secondary games 102. Here, the symbol generator 100 is a set of five reels 34. Each reel 34 displays a plurality of reel symbols 108 identified in FIG. 6 as the capital letter S. When the player activates an input device, such as play button 20, the reels 34 rotate. When the reels 34 stop rotating, if one or more reels 34 display a predetermined symbol 108, the gaming device operates or plays the secondary games 102, each of which is associated with a reel 34.

Figure 7:
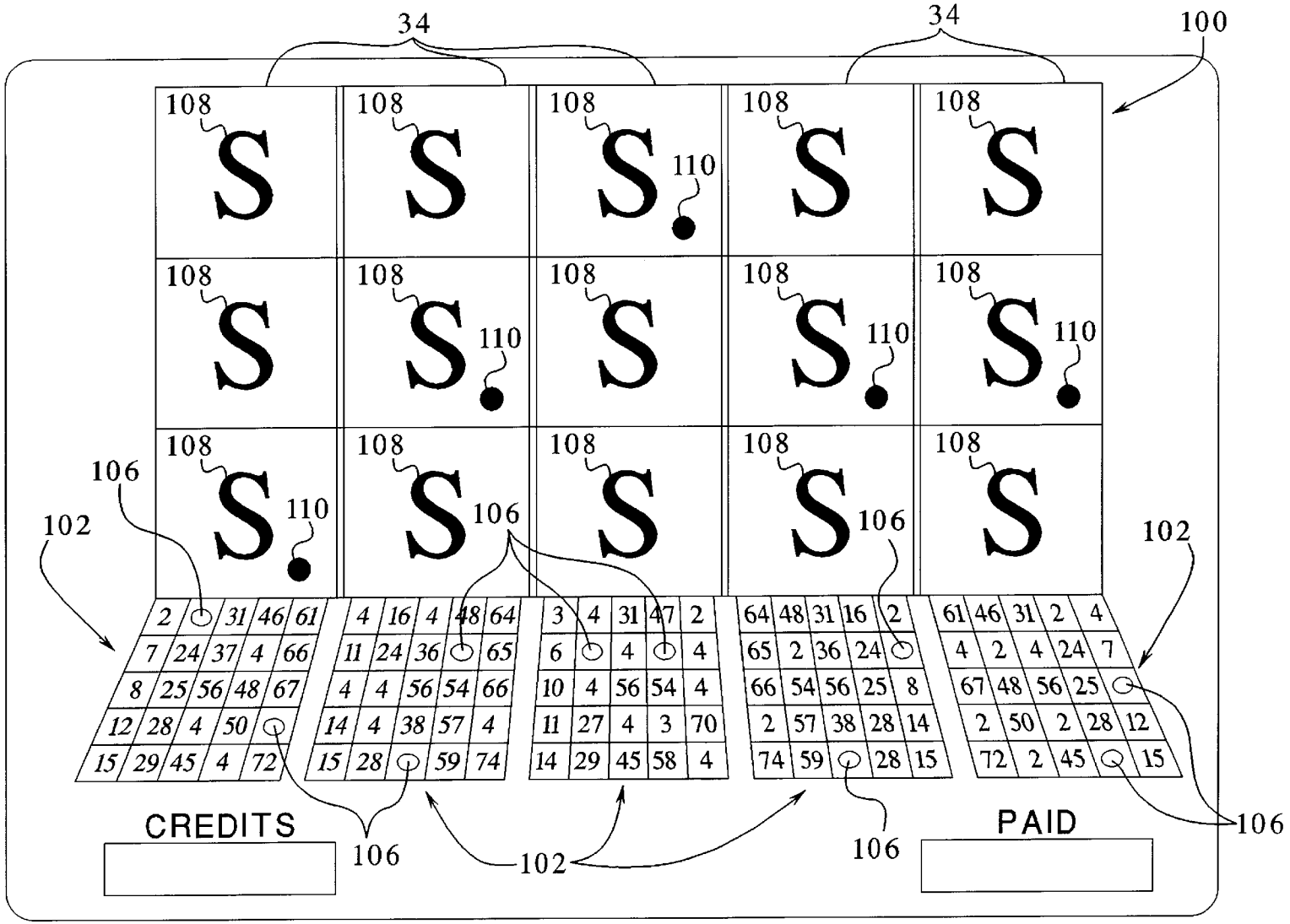
FIG. 7 is a top plan view of a primary game in progress in one embodiment of the present invention.
Figure 8:
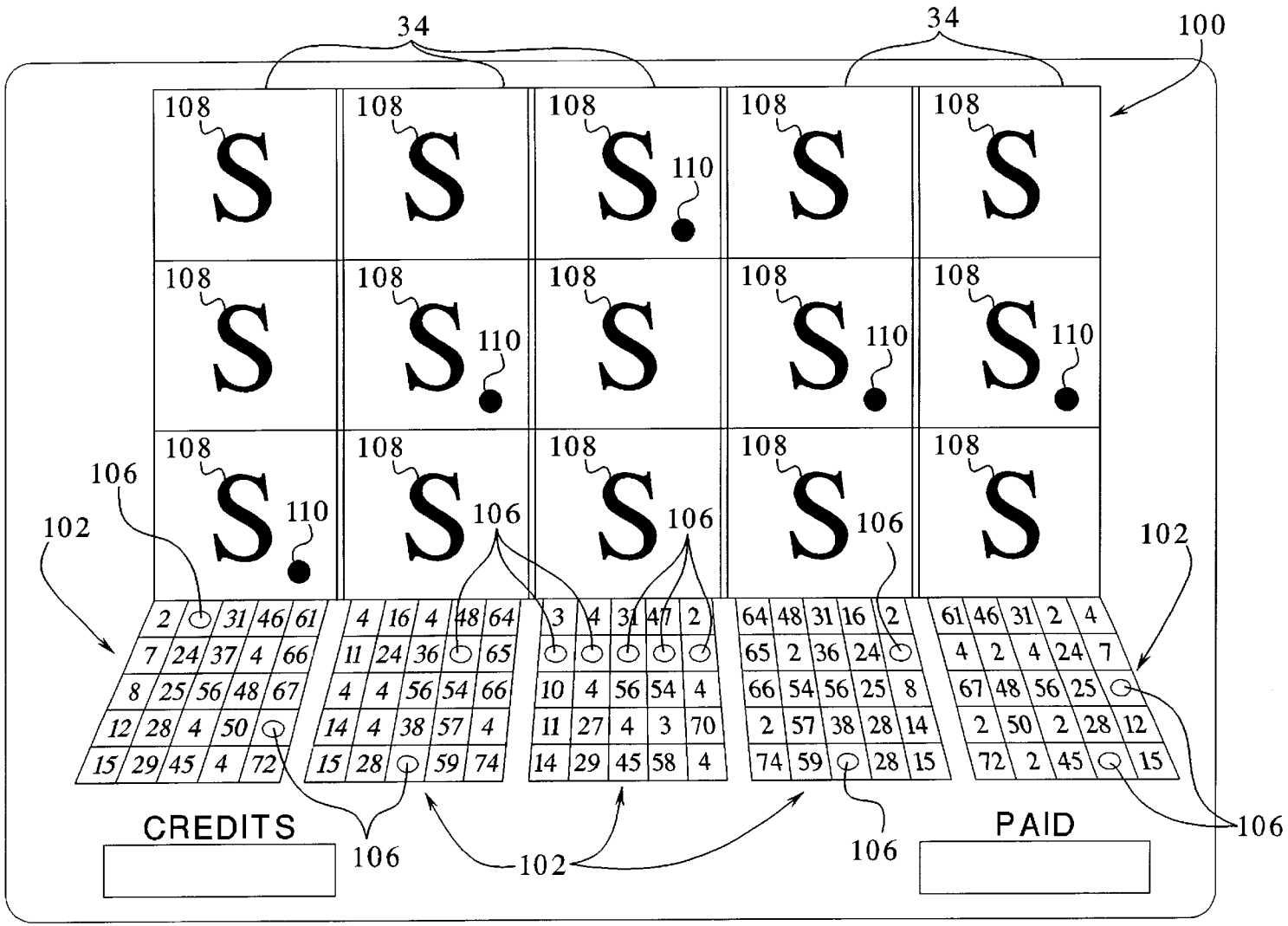
FIG. 8 is a top plan view of a secondary game win condition in a primary game in one embodiment of the present invention.

The secondary games 102 shown in FIG. 6 generally operate in the same manner of the secondary game 102 illustrated in FIG. 4. However, here the locations of the secondary games 102 are identified by and associated with numerals as shown in FIGS. 6 through 8. In addition, when the player reaches a predetermined reel symbol 108 on any one reel 34, the gaming device displays a cross-game symbol 110 on that reel 134 and moves the cross-game symbol 110 from the reel 34 to the secondary game 102 associated with that reel 34. Furthermore, the cross-game symbol 110 bears a numeric message which indicates the numeral of the location on the grid where the marker 106 will be positioned. In this preferred embodiment, the cross-game symbol 110 is the same as marker 106. Therefore, the gaming device moves the cross-game symbols 110 from the reels 34 to the locations on the secondary games 102. There, the cross-game symbol 110 functions as a marker 106. It should be appreciated that the present invention can be adapted to enable the player to gain value associated with a location when a marker is displayed at a location.

Initially, it is preferable that in this preferred embodiment the primary game begins with no markers 106 being displayed at any of the secondary games 102, as shown in FIG. 6. However, the present invention can be adapted so that the primary game begins with one or more markers 106 being displayed at one or more of the secondary games 102. In operation, the gaming device causes reels 34 to spin. On each spin the secondary game associated with each reel may or may not progress. As each reel 34 displays predetermined reel symbols 108, the gaming device displays cross-game symbols 110. The cross-game symbols indicate where the marker 106 will be located in the associated secondary game by displaying a numeral momentarily. Then the gaming device moves the cross-game symbols 110 from the reels 34 to the associated secondary games 102 where the cross-game symbols function as markers 106. The present invention can be adapted so that when a marker 106 is located at a location on a secondary game 102, the gaming device provides the player with the value associated with that location.

In time, one or more secondary games 102 accumulate a plurality of markers 106 as shown in FIG. 7. It should be appreciated that, when a reel displays a predetermined reel symbol 108, the gaming device can display more than one marker 106 at any one secondary game 102. In FIG. 8, secondary game 102 associated with the middle reel 34 displays a complete row of markers 106. In this example, when a player achieves this complete row, the secondary game 102 provides the player with an award. Preferably, the award is the triggering of a bonus round where the player can accumulate additional value. The secondary games can clear and restart themselves when any predetermined event or events occur.

The game scheme of the present invention provides gaming devices with secondary games which accompany traditional symbol generators in primary games. When a symbol generator generates one or more predetermined symbols, the gaming device operates or plays one or more secondary games. Preferably, the symbol generator is a plurality of reels and each reel is associated with an independent secondary game. Furthermore, it is preferable that secondary games require a player to complete multiple steps before reaching a win condition in the secondary games. When a win condition occurs, the secondary game provides the player with an award. Preferably, this award is a bonus value, a credit or the triggering of a bonus round.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is claimed as follows:

1. A gaming device comprising:

a primary game;

a plurality of wheels in the primary game, each said wheel having a plurality of symbols thereon including at least one predetermined symbol;

a plurality of independently operated secondary games which are each associated with a different one of said wheels;

at least one display device for displaying the secondary games; and a processor in communication with the wheels and for controlling the display device and the secondary games, wherein when one of the predetermined symbols occurs on one of wheels, the processor only operates the secondary game associated with said wheel.

2. The gaming device of claim 1, wherein each secondary game includes at least one win condition.

3. The gaming device of claim 2, wherein the win condition includes a plurality of predetermined secondary game symbols.

4. The gaming device of claim 3, wherein the processor provides an award to a player when the win condition in one of the secondary games occurs.

5. The gaming device of claim 4, wherein the award is a value.

6. The gaming device of claim 4, wherein the award is an opportunity to gain a value.

7. The gaming device of claim 6, wherein at least one of the secondary games is a symbol generator.

8. The gaming device of claim 1, wherein at least one of the wheels includes a cross-game symbol which functions on said wheel and in the secondary game associated with said wheel.

9. The gaming device of claim 1, wherein each of the secondary games is a same type of game.

10. The gaming device of claim 1, wherein the display device displays each secondary game adjacent to the wheel said secondary game is associated with to clearly distinguish to a player which secondary game is associated with each wheel.

11. The gaming device of claim 1, wherein the display device simultaneously displays all of the secondary games.

12. The gaming device of claim 1, wherein each wheel includes a plurality of predetermined symbols, wherein when one of the plurality of predetermined symbols occurs on one of wheels, the processor only operates the secondary game associated with said wheel.

13. The gaming device of claim 1, wherein at least one of the secondary games is a symbol generator.

14. A gaming device comprising:

a primary game;

a plurality of wheels in the primary game, each said wheel having a plurality of symbols thereon including at least one predetermined symbol;

a separate independently operated secondary game associated with each of said wheels;

at least one display device for displaying the secondary games; and a processor in communication with the wheels and for controlling the display device and the secondary games, wherein when one of the predetermined symbols occurs on one of wheels, the processor independently operates the secondary game associated with said wheel without operating the other secondary games associated with the other wheels.

15. The gaming device of claim 14, wherein each secondary game includes at least one win condition.

16. The gaming device of claim 15, wherein the processor provides an award to a player when the win condition in one of the secondary games occurs.

17. The gaming device of claim 16, wherein the award is a value.

18. The gaming device of claim 16, wherein the award is an opportunity to gain a value.

19. The gaming device of claim 14, wherein each of the secondary games are the same type of game.

20. The gaming device of claim 14, wherein the display device simultaneously displays all of the secondary games, wherein each secondary game is displayed adjacent to the wheel said secondary game is associated with to clearly distinguish to a player which secondary game is associated with each wheel.

21. A gaming device comprising:

a primary game;

a plurality of wheels in the primary game, each said wheel having a plurality of symbols thereon including at least one predetermined symbol;

a separate independently operated secondary game associated with each of said wheels, wherein each secondary game includes at least one win condition;

at least one display device for displaying the secondary games, wherein the display device simultaneously displays all of the secondary games, each secondary game adjacent to the wheel said secondary game is associated with to clearly distinguish to a player which secondary game is associated with each wheel; and a processor in communication with the wheels and for controlling the display device and the secondary games, wherein when one of the predetermined symbols occurs on one of the wheels, the processor independently operates the secondary game associated with said wheel without operating the other secondary games associated with the other wheels, and wherein the processor provides an award to the player when the win condition in one of the secondary games occurs.

22. A method of operating a gaming device, said method comprising the steps of:

(a) providing a primary game including a plurality of wheels, each said wheel having a plurality of symbols thereon including at least one predetermined symbol;

(b) providing a plurality of independently operated secondary games which are each associated with a different one of said wheels;

(c) initiating the primary game; and (d) when one of the predetermined symbols occur on one of the wheels, operating only the secondary game associated with said wheel.

23. The method of claim 22, wherein each secondary game includes at least one win condition, and which includes the step of providing an award to a player when the win condition in one of the secondary games occurs.

24. The method of claim 22, which includes the step of causing a cross-game symbol to function on one of the wheels and in the secondary game associated with said wheel.

25. The method of claim 22, which includes the step of displaying each secondary game adjacent to the wheel said secondary game is associated with to clearly distinguish to a player which secondary game is associated with each wheel.

26. The method of claim 22, which includes the step of simultaneously displaying all of the secondary games.

27. The method of claim 22, which includes operating the gaming device through a data network.

28. The method of claim 27, wherein the data network is an internet.

29. The method of claim 22, wherein computer instructions for implementing steps (a) to (d) are stored in a memory device.

30. A method of operating a gaming device, said method comprising the steps of:

(a) providing a primary game including a plurality of wheels, each said wheel having a plurality of symbols thereon including at least one predetermined symbol;

(b) providing a separate independently operated secondary game associated with each of said wheels;

(c) initiating the primary game; and (d) when one of the predetermined symbols occur on one of the wheels, independently operating the secondary game associated with said wheel without operating the other secondary games associated with the other wheels.

31. The method of claim 30, wherein each secondary game includes at least one win condition, and which includes the step of providing an award to a player when the win condition in one of the secondary games occurs.

32. The method of claim 30, which includes the step of causing a cross-game symbol to function on one of the wheels and in the secondary game associated with said wheel.

33. The method gaming device of claim 30, which includes the step of displaying each secondary game adjacent to the wheel said secondary game is associated with to clearly distinguish to a player which secondary game is associated with each wheel.

34. The method of claim 30, which includes the step of simultaneously displaying all of the secondary games.

35. The method of claim 30, which includes operating the gaming device through a data network.

36. The method of claim 35, wherein the data network is an internet.

37. The method of claim 30, wherein computer instructions for implementing steps (a) to (d) are stored in a memory device.

38. A method of operating a gaming device, said method comprising the steps of:

(a) providing a primary game including a plurality of wheels, each said wheel having a plurality of symbols thereon including at least one predetermined symbol;

(b) providing a separate independently operated secondary game associated with each of said wheels, wherein each secondary game includes at least one win condition;

(c) simultaneously displaying all of the secondary games, each secondary game adjacent to the wheel said secondary game is associated with to clearly distinguish to a player which secondary game is associated with each wheel (d) initiating the primary game;

(e) when one of the predetermined symbols occurs on one of the wheels in the primary game, independently operating the secondary game associated with said wheel without operating the other secondary games associated with the other wheels; and (f) providing an award to the player when the win condition in one of the secondary games occurs.

39. The method of claim 38, which includes operating the gaming device through a data network.

40. The method of claim 39, wherein the data network is an internet.

41. The method of claim 38, wherein computer instructions for implementing steps (a) to (f) are stored in a memory device.

42. A method of operating a gaming device, said method comprising the steps of:

(a) providing a primary game including a plurality of reels, each said reel having a plurality of symbols thereon including at least one predetermined symbol;

(b) providing a plurality of independently operated secondary games which are each associated with a different one of said reels;

(c) initiating the primary game; and (d) when one of the predetermined symbols occur on one of the reels, operating only the secondary game associated with said reel.

43. The method of claim 42, wherein each secondary game includes at least one win condition, and which includes the step of providing an award to a player when the win condition in one of the secondary games occurs.

44. The method of claim 42, which includes the step of causing a cross-game symbol to function on one of the reels and in the secondary game associated with said reel.

45. The method of claim 42, which includes the step of displaying each secondary game adjacent to the reel said secondary game is associated with to clearly distinguish to a player which secondary game is associated with each reel.

46. The method of claim 42, which includes the step of simultaneously displaying all of the secondary games.

47. The method of claim 42, which includes operating the gaming device through a data network.

48. The method of claim 47, wherein the data network is an internet.

49. The method of claim 42, wherein computer instructions for implementing steps (a) to (d) are stored in a memory device.

50. A method of operating a gaming device, said method comprising the steps of:

(a) providing a primary game including a plurality of reels, each said reel having a plurality of symbols thereon including at least one predetermined symbol;

(b) providing a separate independently operated secondary game associated with each of said reels;

(c) initiating the primary game; and (d) when one of the predetermined symbols occur on one of the reels, independently operating the secondary game associated with said reel without operating the other secondary games associated with the other reels.

51. The method of claim 50, wherein each secondary game includes at least one win condition, and which includes the step of providing an award to a player when the win condition in one of the secondary games occurs.

52. The method of claim 50, which includes the step of causing a cross-game symbol to function on one of the reels and in the secondary game associated with said reel.

53. The method gaming device of claim 50, which includes the step of displaying each secondary game adjacent to the reel said secondary game is associated with to clearly distinguish to a player which secondary game is associated with each reel.

54. The method of claim 50, which includes the step of simultaneously displaying all of the secondary games.

55. The method of claim 50, which includes operating the gaming device through a data network.

56. The method of claim 55, wherein the data network is an internet.

57. The method of claim 50, wherein computer instructions for implementing steps (a) to (d) are stored in a memory device.

58. A method of operating a gaming device, said method comprising the steps of:

(a) providing a primary game including a plurality of reels, each said reel having a plurality of symbols thereon including at least one predetermined symbol;

(b) providing a separate independently operated secondary game associated with each of said reels, wherein each secondary game includes at least one win condition;

(c) simultaneously displaying all of the secondary games, each secondary game adjacent to the reel said secondary game is associated with to clearly distinguish to a player which secondary game is associated with each reel (d) initiating the primary game;

(e) when one of the predetermined symbols occurs on one of the reels in the primary game, independently operating the secondary game associated with said reel without operating the other secondary games associated with the other reels; and (f) providing an award to the player when the win condition in one of the secondary games occurs.

59. The method of claim 58, which includes operating the gaming device through a data network.

60. The method of claim 59, wherein the data network is an internet.

61. The method of claim 58, wherein computer instructions for implementing steps (a) to (f) are stored in a memory device.

* * * * *